US008596006B2

(12) United States Patent
Bauer

(10) Patent No.: US 8,596,006 B2
(45) Date of Patent: Dec. 3, 2013

(54) SHUTTER

(76) Inventor: John Bauer, Findlay, OH (US)

( * ) Notice: Subject to any disclaimer, the term of this patent is extended or adjusted under 35 U.S.C. 154(b) by 95 days.

(21) Appl. No.: 13/230,335

(22) Filed: Sep. 12, 2011

(65) Prior Publication Data

US 2012/0069553 A1 Mar. 22, 2012

Related U.S. Application Data

(60) Provisional application No. 61/384,575, filed on Sep. 20, 2010.

(51) Int. Cl.
*E06B 7/08* (2006.01)

(52) U.S. Cl.
USPC ..... 52/473; 52/458; 52/800.1

(58) Field of Classification Search
USPC ..... 52/455–458, 473, 800.1
See application file for complete search history.

(56) References Cited

U.S. PATENT DOCUMENTS 4,251,966 A * 2/1981 Foltman ..... 52/309.1
4,765,110 A * 8/1988 MacLeod ..... 52/473
4,858,400 A 8/1989 Foyt
4,974,123 A * 11/1990 Luallin et al. ..... 362/549
5,060,442 A * 10/1991 Chubb ..... 52/473
5,152,116 A * 10/1992 MacGowan ..... 52/473
5,265,391 A 11/1993 Ricard
5,347,782 A * 9/1994 Vagedes ..... 52/473
5,373,677 A * 12/1994 Vagedes ..... 52/473
5,430,986 A 7/1995 Vagedes
5,524,407 A * 6/1996 Ricard et al. ..... 52/473
5,617,688 A * 4/1997 Gandy et al. ..... 52/473
5,634,998 A * 6/1997 Schiedegger et al. ..... 156/73.1
5,704,182 A 1/1998 Schiedegger
5,826,393 A * 10/1998 Wenzlaff et al. ..... 52/473
5,924,255 A * 7/1999 Vagedes ..... 52/473
5,946,873 A 9/1999 Schiedegger
5,996,298 A * 12/1999 Wenzlaff et al. ..... 52/473
6,122,875 A * 9/2000 Schiedegger et al. ..... 52/457
6,263,632 B1 7/2001 Cadorette
7,329,142 B2 * 2/2008 Hanks ..... 439/427
7,617,857 B2 * 11/2009 Froese ..... 160/10

* cited by examiner

*Primary Examiner* — Adriana Figueroa
(74) *Attorney, Agent, or Firm* — Fraser Clemens Martin & Miller LLC; Jacob M. Ward

(57) ABSTRACT

A shutter assembly includes a main body having a first side member and a second side member. Each of the first side member and the second side member has a first attachment feature. The shutter assembly also includes at least one cap. The cap has a pair of spaced apart second attachment features. The first attachment features of the first side member and the second side member of the main body and the second attachment features of the cap cooperate with one another to selectively secure the cap to the main body.

16 Claims, 12 Drawing Sheets

SHUTTER

CROSS-REFERENCE TO RELATED APPLICATIONS

This application claims the benefit of U.S. Provisional Application No. 61/384,575, filed on Sep. 20, 2010. The entire disclosure of the above application is hereby incorporated herein by reference.

FIELD OF THE INVENTION

The present disclosure relates to decorative shutters for exterior surfaces of a residential or commercial dwelling and, more particularly, to a shutter assembly and a method for customizing the shutter assembly.

BACKGROUND OF THE INVENTION

Decorative shutter assemblies are used to provide an aesthetically pleasing appearance to exterior walls of buildings such as residential and commercial dwellings. Typical shutter assemblies are placed on opposite sides of windows of the dwellings. The heights of the windows in the residential and commercial dwellings can vary considerably. It has been heretofore necessary to either supply shutter assemblies of different lengths, or manufacture the shutter assemblies "on-site", and customize the lengths of the shutter assemblies during installation.

A variety of customizable shutter assemblies are known in the art, for example, as described in the following U.S. patents: U.S. Pat. No. 5,152,116 to Macgowan; U.S. Pat. No. 5,060,442 to Chubb; U.S. Pat. No. 4,765,110 to Macleod; U.S. Pat. No. 4,251,966 to Foltman; U.S. Pat. No. 5,265,391 to Ricard et al.; U.S. Pat. No. 5,524,407 to Ricard et al.; U.S. Pat. No. 5,704,182 to Schiedegger et al.; U.S. Pat. No. 5,996,298 to Wenzlaff et al.; U.S. Pat. No. 6,263,632 to Cadorette; U.S. Pat. No. 4,858,400 to Foyt; U.S. Pat. No. 5,347,782 to Vagedes; U.S. Pat. No. 5,373,677 to Vagedes; U.S. Pat. No. 5,430,986 to Vagedes; U.S. Pat. No. 5,946,873 to Schiedegger et al.; and U.S. Pat. No. 6,122,875 to Schiedegger et al. The entire disclosures of each of the aforementioned U.S. patents are hereby incorporated herein by reference.

There is a continuing need for a shutter assembly that can be customized to a variety of different lengths. Desirably, the shutter assembly is inexpensive to manufacture and customized rapidly and easily by a typical home owner.

SUMMARY OF THE INVENTION

In concordance with the instant disclosure, a shutter assembly that can be customized to a variety of different lengths, and which is inexpensive to manufacture and assembled rapidly and easily by a typical home owner, is surprisingly discovered. The shutter is also adjustable in style and design.

In one embodiment, a shutter assembly includes a main body having a first side member and a second side member. Each of the first side member and the second side member has a first attachment feature. The shutter assembly also includes at least one cap having a pair of spaced apart second attachment features. The first attachment features of the main body and the second attachment features of the cap cooperate with one another to selectively secure the cap to the main body.

In another embodiment, a shutter assembly kit includes a main body having a first side member and a second side member. Each of the first side member and the second side member has a first attachment feature. The shutter assembly kit also includes at least one cap having a pair of spaced apart second attachment features. The first attachment features of the main body and the second attachment features of the cap are configured to cooperate with one another to selectively secure the cap to the main body.

In a further embodiment, a method for customizing a shutter assembly includes the steps of: providing a shutter assembly kit having a main body with a first side member and a second side member, each of the first side member and the second side member having a first attachment feature, and the shutter assembly further having at least one cap having a pair of second attachment features, the first attachment features of the main body and the second attachment features of the cap configured to cooperate with one another to selectively secure the cap to the main body; determining a desired length of the main body; shortening the main body to the desired length; and attaching the cap to the main body.

DRAWINGS

The above, as well as other advantages of the present disclosure, will become readily apparent to those skilled in the art from the following detailed description, particularly when considered in the light of the drawings described herein.

DETAILED DESCRIPTION OF THE INVENTION

Figure 1:
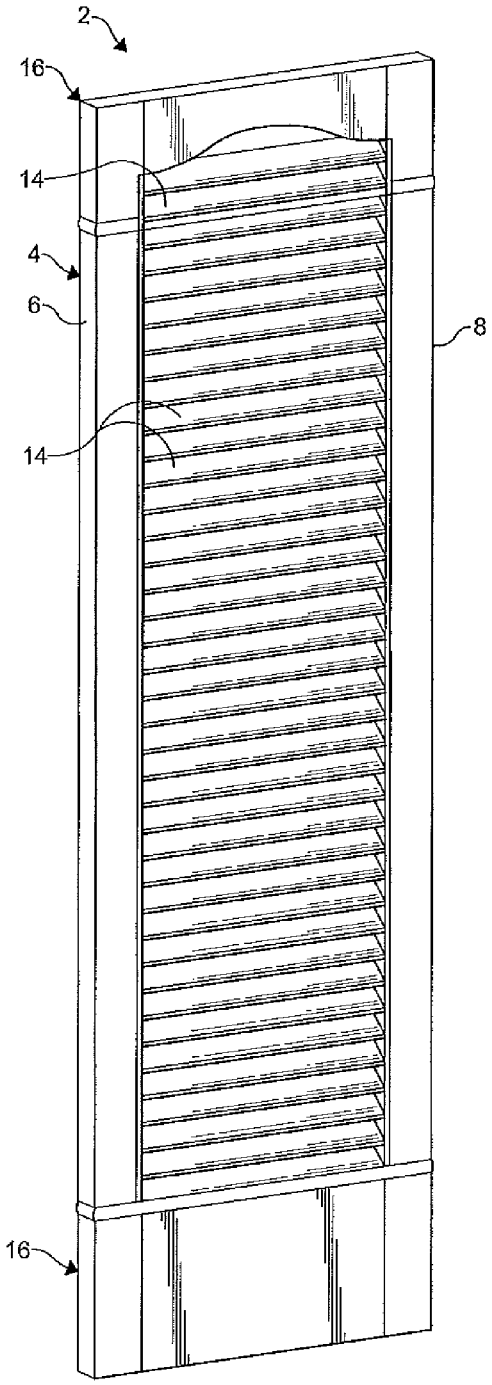
FIG. 1 is a front perspective view of a shutter assembly according to one embodiment of the present disclosure.
Figure 2:
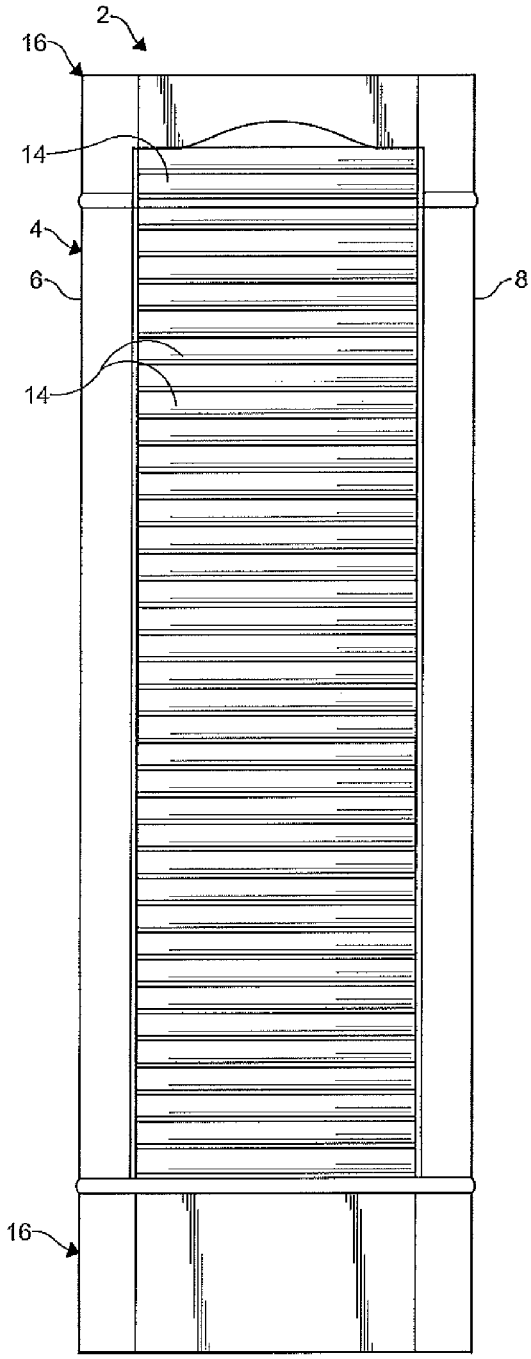
FIG. 2 is a front elevational view of the shutter assembly shown in FIG. 1.
Figure 3:
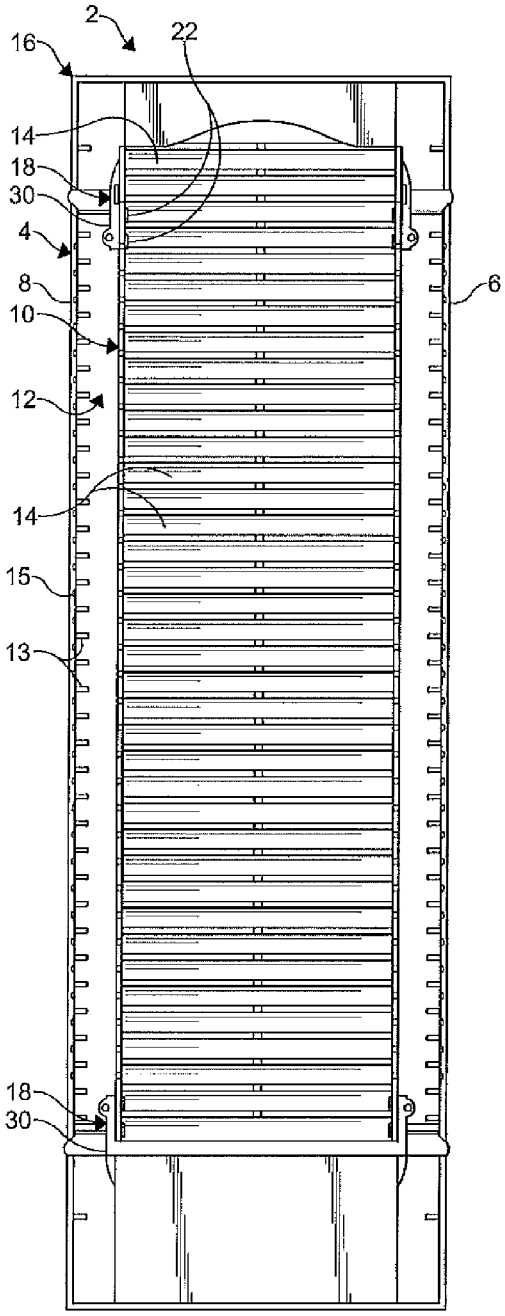
FIG. 3 is a rear elevational view of the shutter assembly shown in FIGS. 1 and 2.
Figure 4:
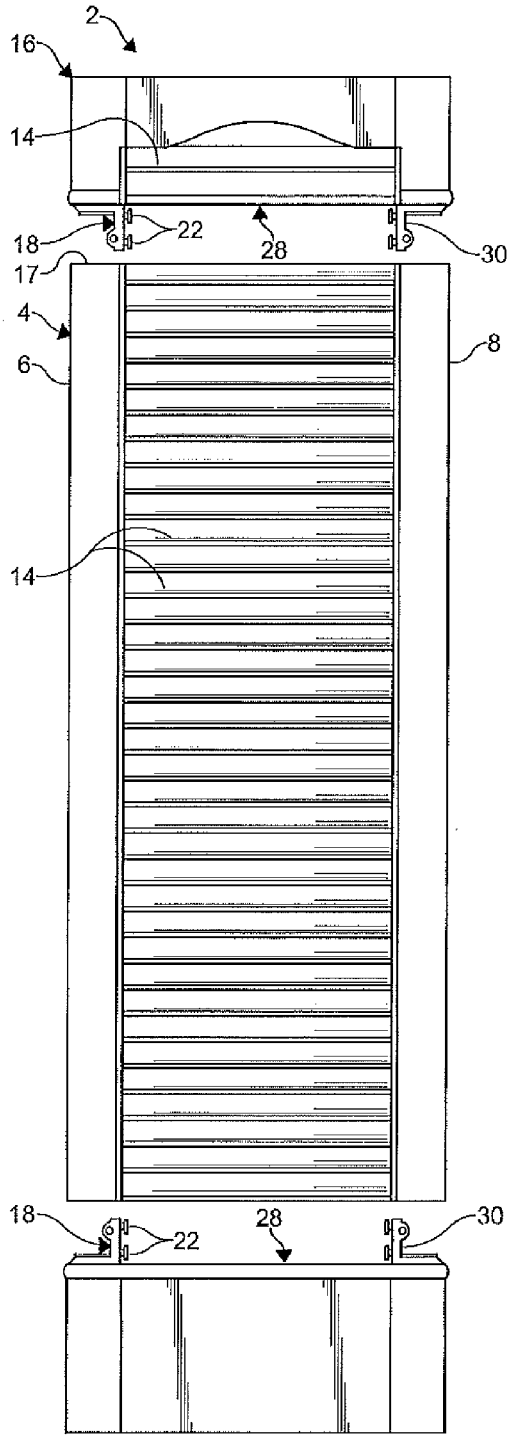
FIG. 4 is an exploded front elevational view of the shutter assembly shown in FIGS. 1 to 3.
Figure 5:
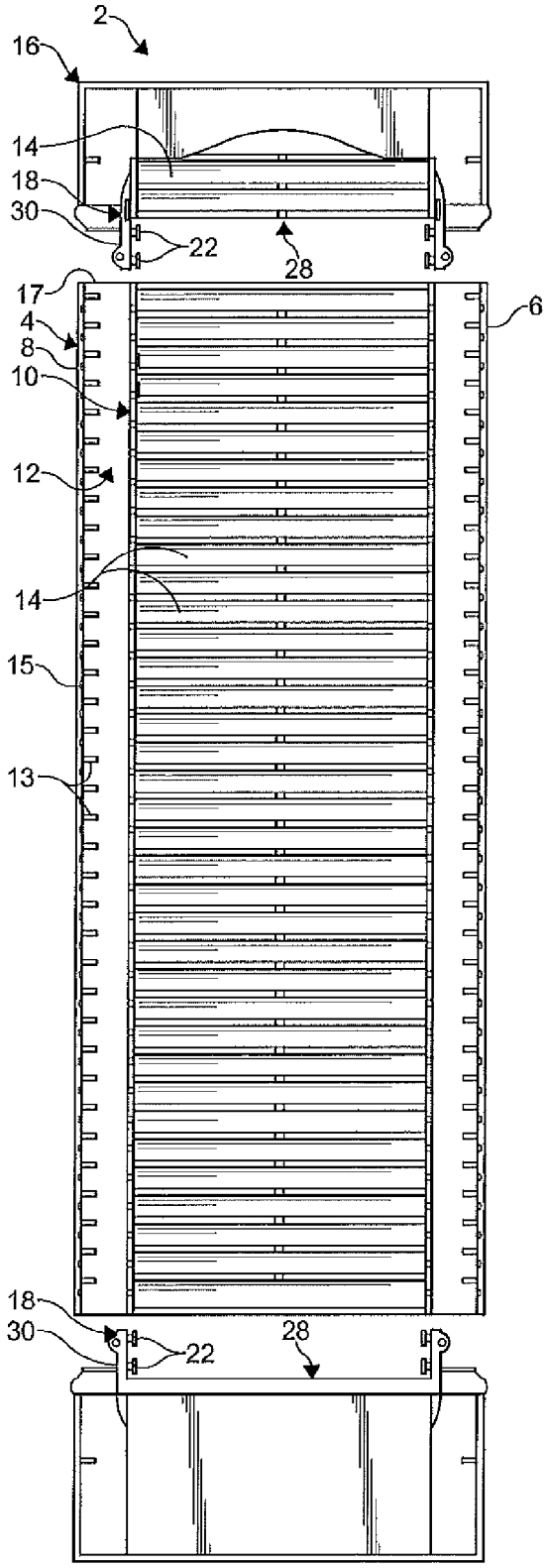
FIG. 5 is an exploded rear elevational view of the shutter assembly shown in FIGS. 1 to 4.

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, are not necessary or critical.

As shown in FIGS. 1-17, the present disclosure includes a customizable shutter assembly 2. Although shown in the drawings with respect to a louvered shutter assembly 2, it should be understood that the present invention is also applicable to raised panel shutters. Any material having suitable resistance to outdoor exposure may be used for the shutter assembly 2 including woods, plastics, or composite materials are particular nonlimiting examples. Other shutter-related uses and materials are also within the scope of the present disclosure.

The shutter assembly 2 has at least one main body 4. The main body 4 may include a first side member 6 and a second side member 8. The first side member 6 and the second side member 8 are oriented substantially vertically. The first side member 6 and the second side member 8 may be vertical stiles of the shutter assembly 2, for example.

Each of the first and second side members 6, 8 has a first attachment feature 10. In a particular embodiment, each of the first side member 6 and the second side member 8 is elongate and has a channel 12 formed therein. A plurality of support ribs 13 may be formed within the channel 12 and militate against a folding of each of the first side member 6 and the second side member 8. Other means for supporting the first side member 6 and the second side member 8 having the channels 12 may also be used, as desired.

The main body 4 may also have one or more louvers 14, horizontal members (not shown), and decorative features (not shown) disposed between the first side member 6 and the second side member 8, as desired. The louvers 14 may be open or closed, for example. The horizontal member may be a snap-in mullion that permits the selective vertical placement of the horizontal member along the length of the main body 4, as a nonlimiting example. The decorative features may include plates for names or numbers, or name, numbers, logos, etc. formed directly in the main body 4, as particular nonlimiting examples. Other types of louvers 14, horizontal members, and decorative features may also be employed within the scope of the present disclosure.

The main body 4 of the shutter assembly 2 is configured to be shortened to a desired length, for example, by cutting the main body 4. The desired length may be based, for example, on a height of a window of a building or dwelling where the shutter assembly 2 is to be installed. The shortening of the main body 4 may be facilitated by cutting guides 15 such as notches formed in the first side member 6 and the second side member 8. In another embodiment, the cutting guides 15 may consist of marks formed on the first and second side members 6, 8. It should also be appreciated that the cutting guides 15 facilitate an even or level cut of the main body 4 when the desired length is known and the cutting guides 15 are used.

As a nonlimiting example, the cutting guides 15 may be spaced apart substantially evenly along the length of the main body 4. For example, the cutting guides may be spaced apart approximately every inch (1") of the main body 4, in order that the main body 4 may be precisely shortened. Other means for shortening the main body 4 and determining the desired length may also be employed within the scope of the present disclosure.

The shutter assembly 2 further includes at least one cap 16. The cap 16 is configured to form an end of the shutter assembly 2. The cap 16 may be provided with different designs, for example, arches or other shapes to conform to the shape of the adjacent window or to personalize the style of the shutter assembly 2, as desired. Like the main body 4, the cap 16 may also include one or more louvers 14, horizontal members, and decorative features, as desired.

In the embodiment shown in FIGS. 1-5, the shutter assembly 2 includes a pair of caps 16 that may each be disposed, respectively, at opposing top and bottom ends of the main body 4. The cap 16 advantageously covers a cut edge 17 of the main body 4 after the main body 4 has been shortened to the desired length.

The cap 16 has a pair of spaced apart second attachment features 18. The second attachment features 18 may be received by the channel 12 of the first side member 6 and the second side member 8, for example. In a particular embodiment, the first attachment features 10 of the main body 4 may include a plurality of apertures 20 formed in the first and second side members 6, 8, and the second attachment features 18 of the cap 16 include a plurality of retaining pins 22. The apertures 20 are particularly formed in walls defining portions of the channels 12 of each of the first and second side members 6, 8.

The retaining pins 22 cooperate with the apertures 20 to selectively secure the cap 16 to the main body 4. In particular, the retaining pins 22 include splits 24 and beveled heads 26 to facilitate an insertion and retention of the retaining pins 22 in the apertures 20. Other types of retaining pins 22 may also be used within the scope of the present disclosure.

In other embodiments, each of the first attachment features 10 and the second attachment features 18 may include cooperating locking teeth (not shown) for further securing the cap 16 to the main body 4.

Figure 6:
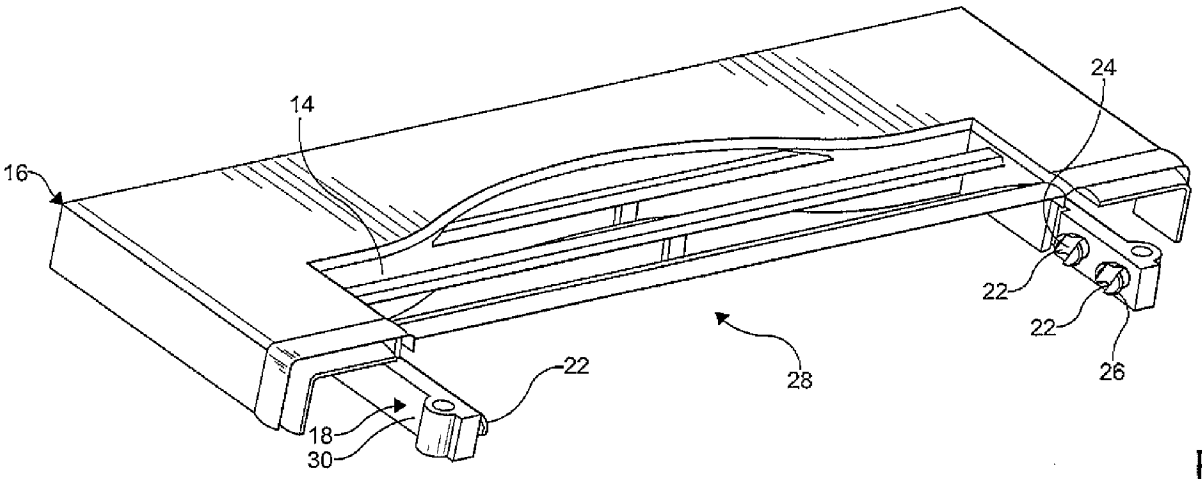
FIG. 6 is a front perspective view of one of a pair of caps for the shutter assembly shown in FIGS. 1 to 5.
Figure 7:
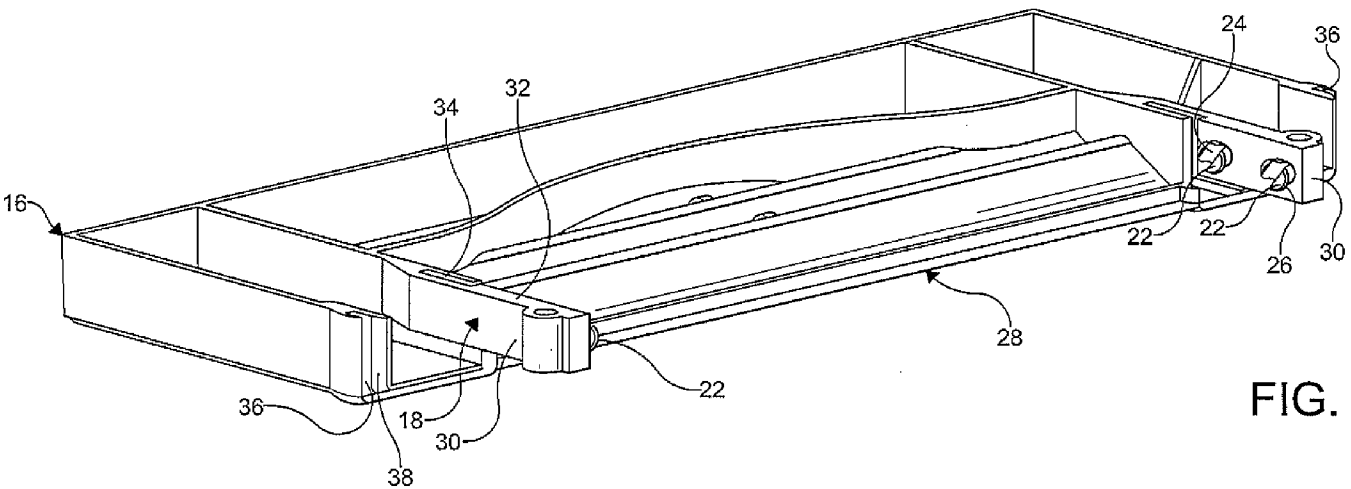
FIG. 7 is a rear perspective view of the cap for the shutter assembly shown in FIG. 6.
Figure 8:
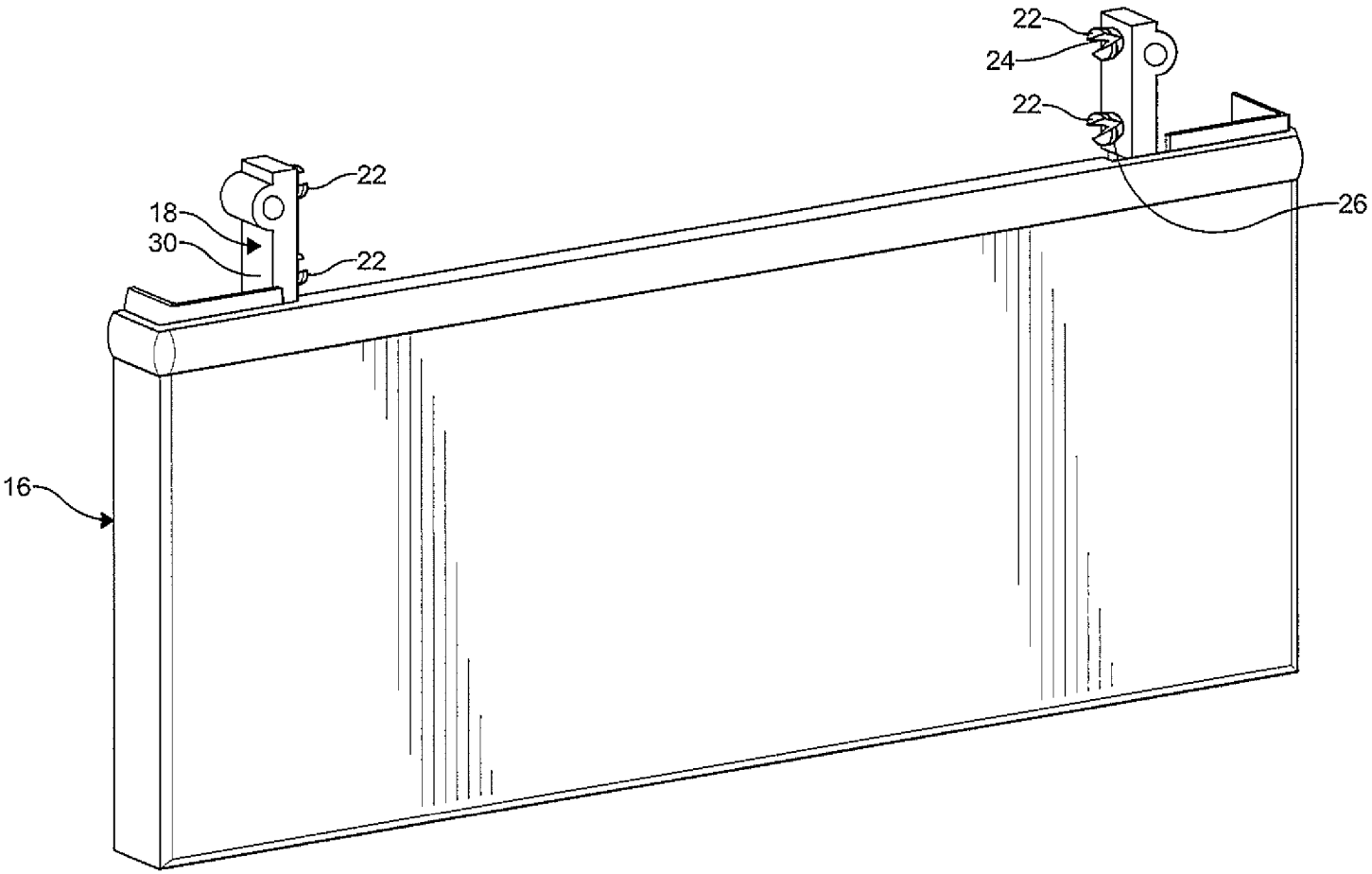
FIG. 8 is a front perspective view of another of the pair of caps for the shutter assembly shown in FIGS. 1 to 5.
Figure 9:
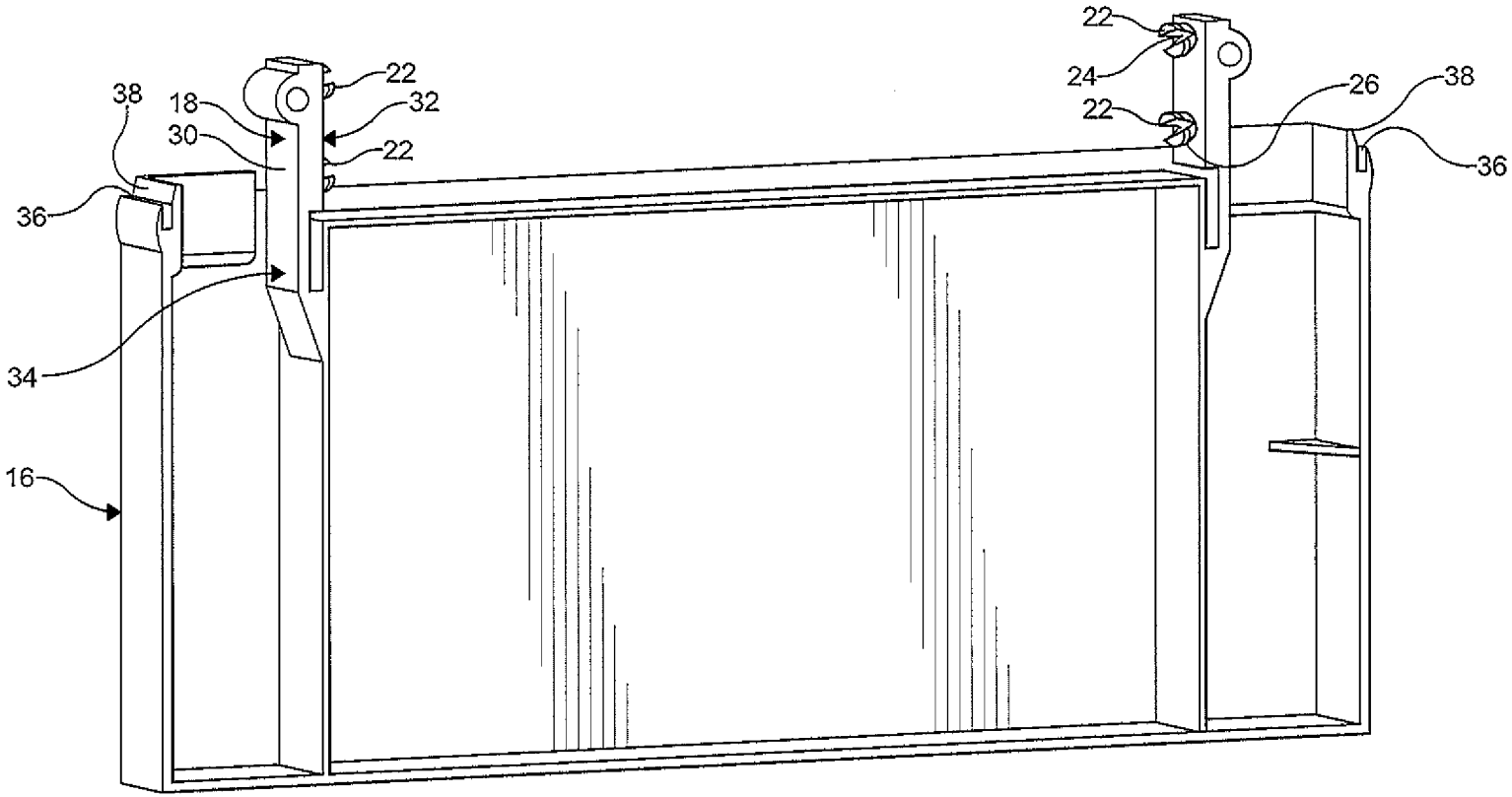
FIG. 9 is a rear perspective view of the cap for the shutter assembly shown in FIG. 8.

With reference to FIGS. 6-9, the cap 16 of the present disclosure is shown in greater detail. FIGS. 6-7 illustrate the "top" cap of the shutter assembly 2 for placement at a top of the main body 4, and FIGS. 8-9 illustrate the "bottom" cap of the shutter assembly 2 for placement at a bottom of the main body 4. Although the pair of the caps 16 is shown for purposes of illustration, it should be understood that a single one of the caps 16 may be disposed at the top or the bottom of the main body 4, as desired.

The second attachment features 18 of the cap 16 are spaced apart from one another on a bottom side 28 of the cap 16. The second attachment features 18 include arms 30 that extend outwardly from the bottom side 28 of the cap 16. The retaining pins 22 are disposed on the arms 30. The pins 22 may be formed integrally with the arms 30 of the second attachment features 18, or may be separate components joined with the arms 30 of the second attachment features 18, as desired.

In an illustrative embodiment, each of the arms 30 has an attaching portion 32 and a flexing portion 34. The pair of pins 22 is disposed on the attaching portion 32. The attaching portion 32 is a free end coupled to the flexing portion 34. The flexing portion 34 is coupled to the cap 16. The flexing portion 34 has a thickness less than a thickness of the attaching portion 32. The difference in thickness desirably permits a flexing of the second attachment features 18 when inserted into the main body 4 and cooperating with the first attachment features 10.

With further reference to FIGS. 6-9, the bottom side 28 of the cap 16 also has a groove 36 formed therein. The groove 36 is configured to receive the cut edge 17 of the main body 4. In particular embodiments, the groove 36 has a beveled edge 38 that facilitates the insertion of the cut edge 17 of the main body 4 into the groove 36 during an assembly of the shutter assembly 2. It should be appreciated that the groove 36 advantageously hides any rough or uneven edges of the main body 4, and contributes to the aesthetic appearance of the assembled shutter assembly 2.

Figure 10:
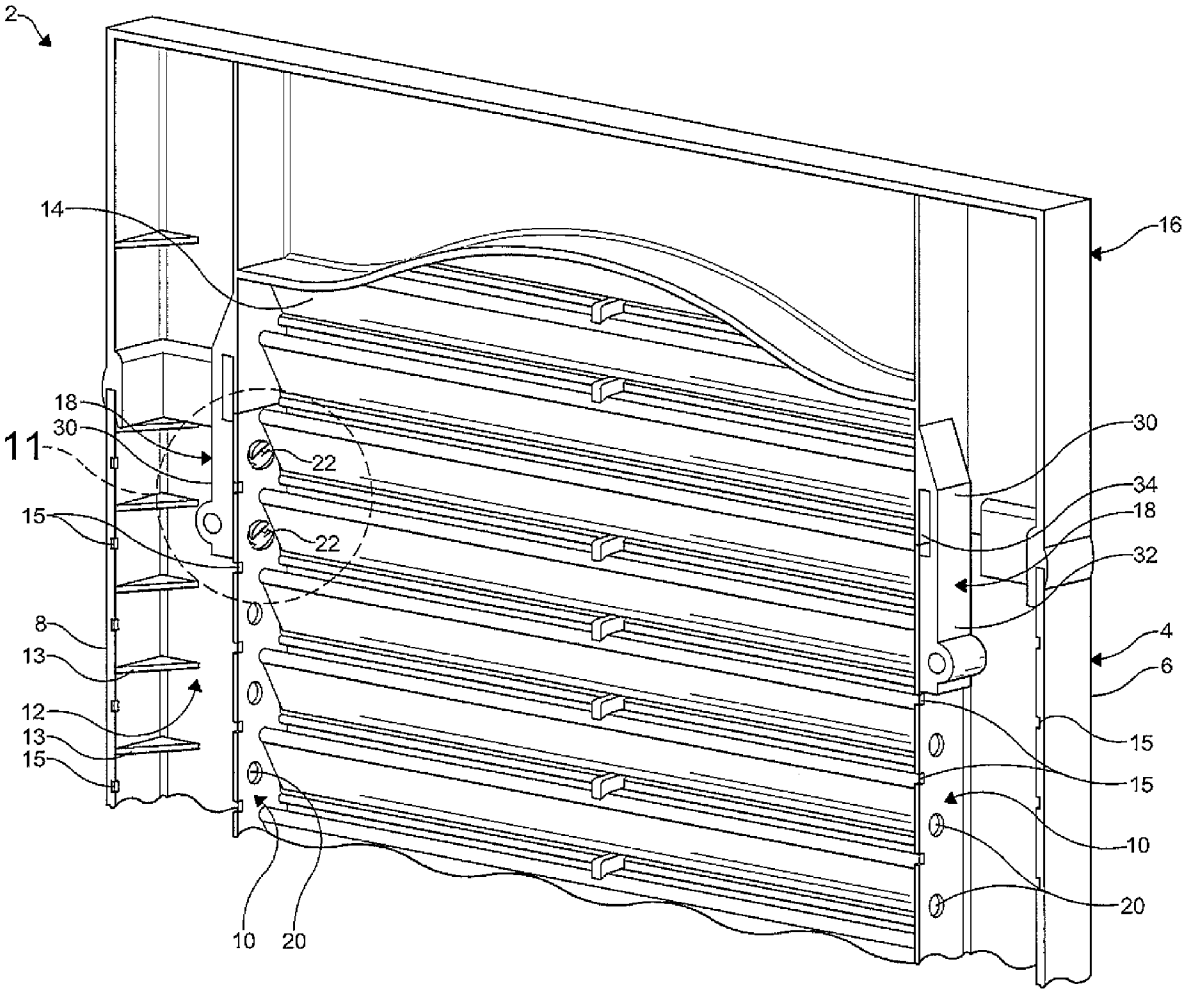
FIG. 10 is an enlarged fragmentary rear perspective view of the shutter assembly shown in FIGS. 1 to 5, illustrating a cooperation of a cap with a main body of the shutter assembly.
Figure 11:
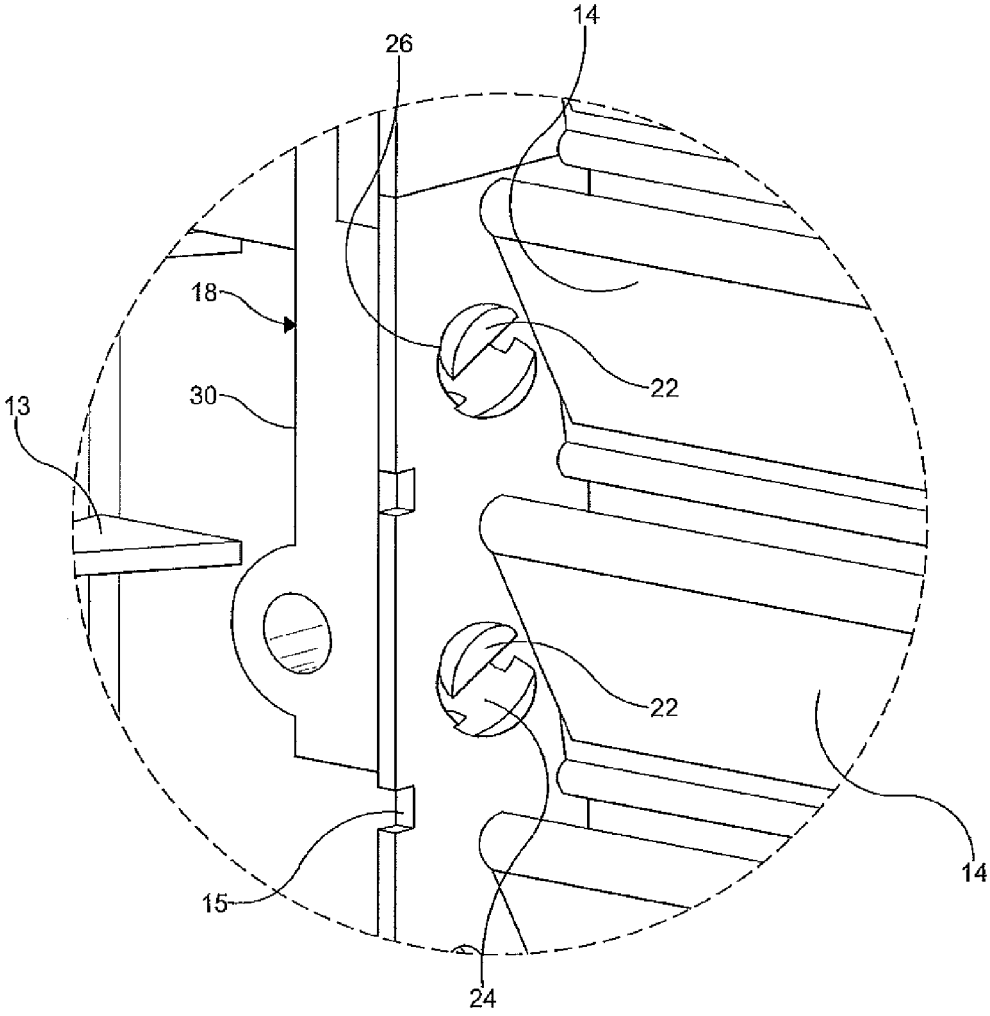
FIG. 11 is an enlarged rear perspective view of the shutter assembly taken at callout 11 in FIG. 10, illustrating a cooperation of retaining pins of the cap with apertures of the main body.

As shown in FIGS. 10-11, the first attachment features 10 of the main body 4 may cooperate with second attachment features 18 of the cap 16 to selectively secure the main body 4 to the cap 16. The first attachment features 10 of the main body 4 are formed on the first side member 6 and the second side member 8. The first attachment features 10 are configured to receive the second attachment features 18 of the cap 16. For example, the first side member 6 and the second side member 8 may each be substantially U-shaped in cross section to provide the channel 12 for receiving the arms 30 of the cap 16.

Figure 12:
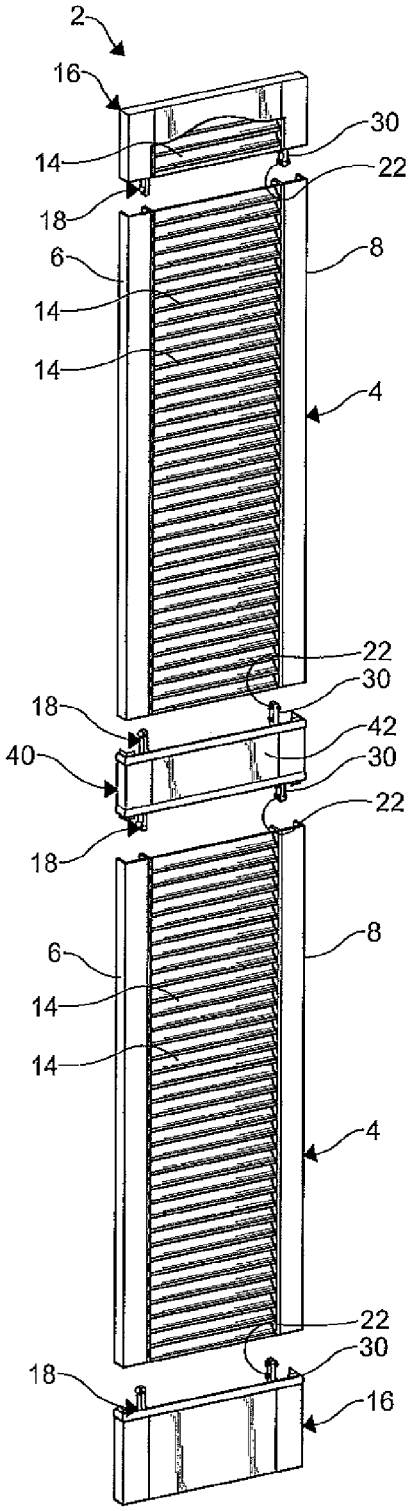
FIG. 12 is an exploded front perspective view of a shutter assembly according to another embodiment of the present disclosure, the shutter assembly including an extender for modifying a length of the shutter assembly.
Figure 13:
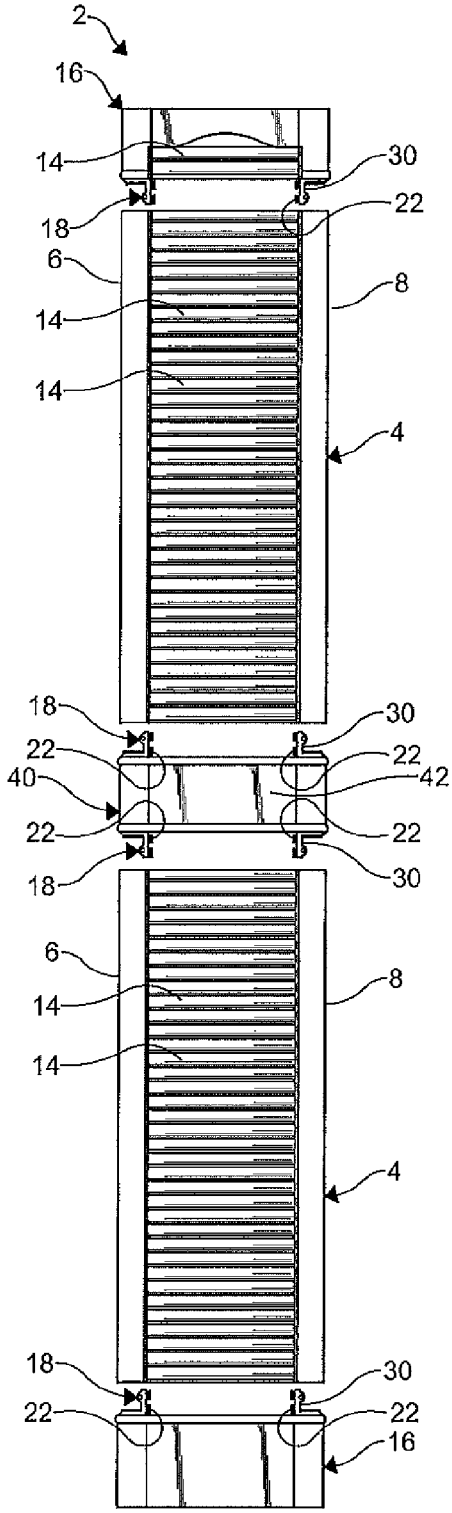
FIG. 13 is an exploded front elevational view of the shutter assembly shown in FIG. 12.
Figure 14:
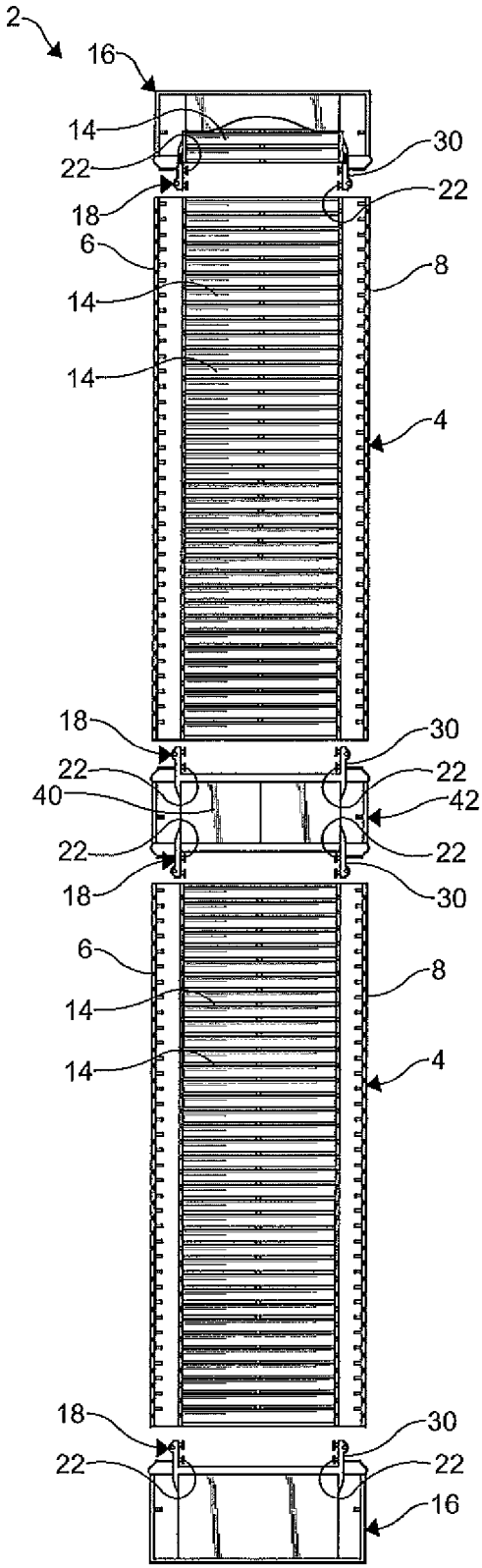
FIG. 14 is an exploded rear elevational view of the shutter assembly shown in FIGS. 12 to 13.

Referring now to FIGS. 12-14, the shutter assembly 2 according to another embodiment is shown. The shutter assembly 2 may include an extender 40 that permits the attachment of another main body 4 to modify the length of the shutter assembly 2. The extender 40 may have a primary body 42 including additional pairs of the second attachment features 18 on opposing sides thereof. As with the second attachment features 18 of the cap 16, the second attachment features 18 of the extender 40 may include the outwardly extending arms 30 with the pairs of retaining pins 22. The second attachment features 18 of the extender 40 and the first attachment features 10 of the main bodies 4 cooperate to selectively secure the extender 40 between the main bodies 4 to extend the length of the shutter assembly 2. A plurality of the main bodies 4 may be connected with the extender 40 to further provide the desired length for the shutter assembly 2.

Figure 15:
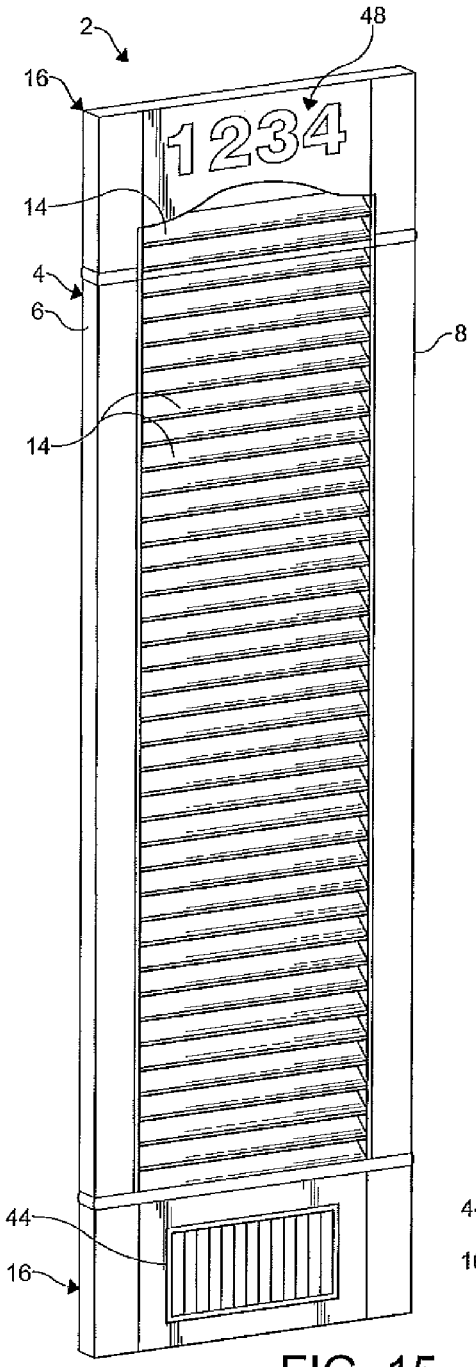
FIG. 15 is a front perspective view of a shutter assembly according to a further embodiment of the present disclosure, the shutter assembly including a solar panel and a backlight behind a decorative feature.
Figure 16:
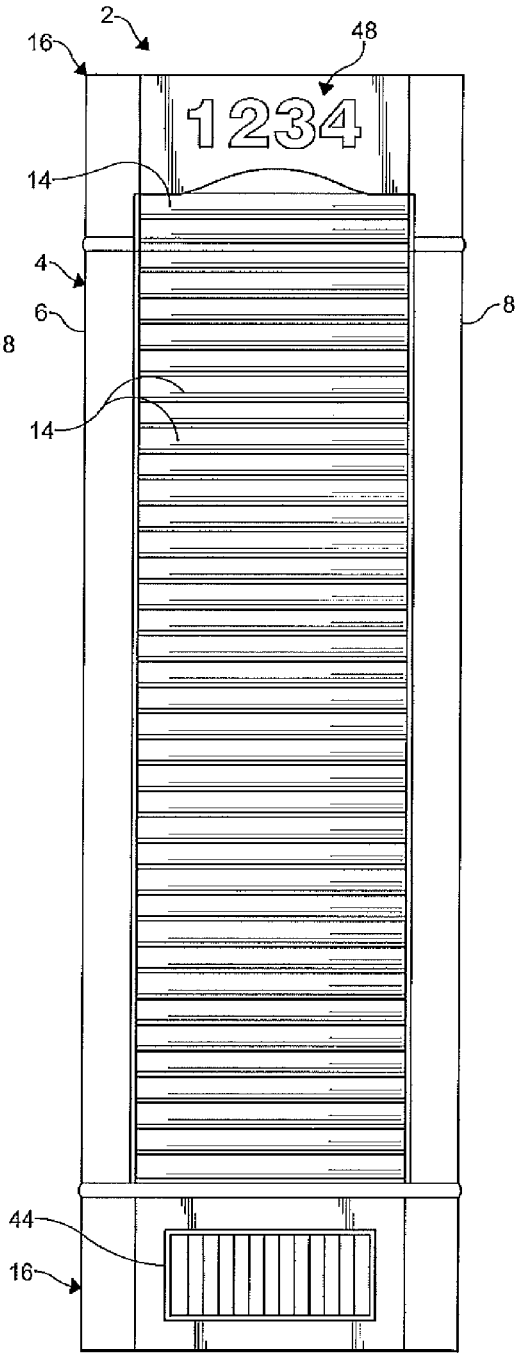
FIG. 16 is a front elevational view of the shutter assembly shown in FIG. 15.
Figure 17:
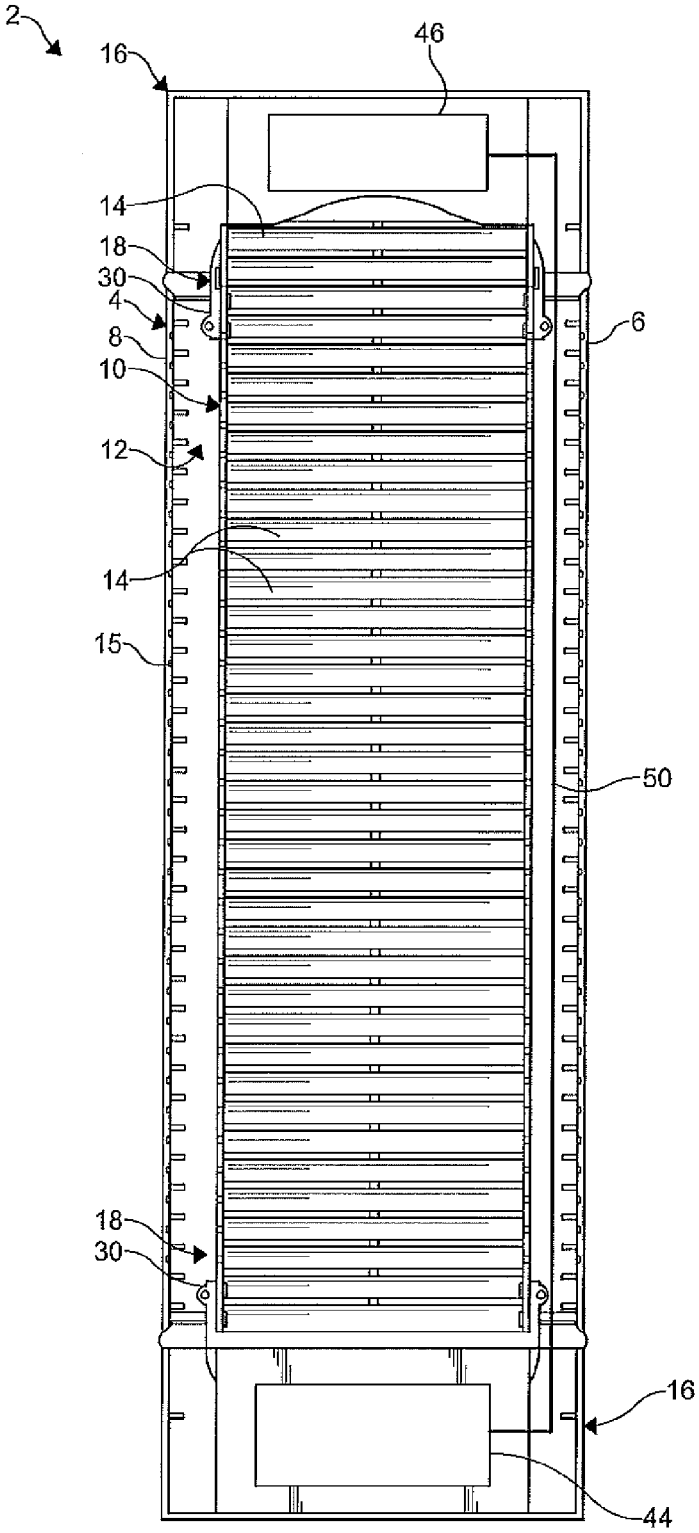
FIG. 17 is a rear elevational view of the shutter assembly shown in FIGS. 15-16.

With reference to FIGS. 15-17, the shutter assembly 2 according to a further embodiment is shown. In the further embodiment, at least one of the main body 4 and the cap 16 of the shutter assembly 2 may include a solar module 44. Although the solar module 44 is shown disposed in one of the caps 16, it should be appreciated that the solar module 44 may likewise be disposed in the main body 4, or spaced apart from the shutter assembly 2, as desired. The solar module 44 may alternatively be disposed in the extender 40 shown in FIGS. 12-14.

The solar module 44 may include any solar panel assembly adapted to generate electrical power from sunlight. The solar module 44 may include a storage device (not shown) such as a rechargeable battery, as a nonlimiting example, for storing electrical power generated by the solar module 44. The solar module 44 is configured to power a light source 46 such as a light bulb or LED, as nonlimiting examples, disposed adjacent one of the main body 4, the cap 16, and the extender 40. The light source 46 may alternatively be disposed within one of the main body 4, the cap 16, and the extender 40, as desired. The solar module 44 may also have a controller (not shown) adapted to automatically or manually control the powering of the light source 46, as desired.

As shown in FIG. 17, the solar module 44 is in electrical communication with the light source 46 via a wire 50. The light source 46 may be disposed behind a decorative feature 48 of the cap 16. Although the decorative feature 48 is shown as including decorative numbers, it should be appreciated that any other type of decorative feature may also be used within the scope of the present disclosure.

In another embodiment, a plurality of lights may be disposed inside of the channels 12 of the first and second side members 6, 8 to providing backlighting along the length of the shutter assembly 2. Other distributions of lighting on or around the shutter assembly may also be employed, as desired.

In other embodiments, at least one of the main body 4 and the cap 16 may also include a snap-in mullion (not shown) for personalizing the shutter assembly 2, for example, for placing a company name or a decorative feature on the shutter assembly 2.

It should be understood that the shutter assembly 2 of the present disclosure may be assembled from a kit. The kit separately includes the at least one main body 4 having the first side member 6 and the second side member 8, each further having the first attachment feature 10, and the at least one cap 16 having the pair of spaced apart second attachment features 18. As described hereinabove, the first attachment features 10 of the main body 4 and the second attachment features 18 of the cap 16 are configured to cooperate with one another to selectively secure the cap 16 to the main body 4.

The shutter assembly 2 may be customized and assembled from the kit according to a method of the present disclosure. For example, after determining the desired length of the main body 4, and shortening the main body 4 to the desired length, the cap 16 is attached to the main body 4. The second attachment features 18 of the cap 16 are inserted into the first attachment features 10 of the main body 4. The respective first attachment features 10 and second attachment features 18 cooperate with one another to secure the cap 16 to the main body 4. It should be understood that the first attachment features 10 and second attachment features 18 square up the cap 16 and militate against a front-back and left-right or lateral pivoting of the cap 16 relative to the main body 4. The shutter assembly 2 having the desired length is thereby assembled.

Advantageously, the shutter assembly 2 and related kit of the present disclosure provide a number of benefits to an end-user of the shutter assembly 2. For example, the shutter assembly 2 may be purchased "off-the-shelf" and readily customized by the end-user. The shutter assembly 2 thereby minimizes the cost and waiting time normally associated with having the shutter assembly 2 customized by a manufacturer. The "off-the-shelf" customization reduces administrative and distribution costs for retailers who otherwise would need to "special order" to have the same flexibility in product offerings.

It should also be appreciated that the shutter assembly 2 of the present disclosure allows for a nearly limitless variety of style and size modifications. Thus, a reduction of up to seventy-five percent (75%) in the number of stock-keeping unit (SKU) for shutters at mass retailers is expected. Additionally, due to the simple customization of the shutter assembly 2, the shutter assembly 2 is a viable "stock" item (as opposed to a custom ordered item) for smaller retailers such as hardware stores and lumber yards. There is also an advantage to the manufacturer, as existing structures require a variety of separate costly molds for each size of shutter, whereas the present shutter assembly 2 may be provided in limitless sizes with the same mold.

While certain representative embodiments and details have been shown for purposes of illustrating the invention, it will be apparent to those skilled in the art that various changes may be made without departing from the scope of the disclosure, which is further described in the following appended claims.

What is claimed is:

1. A shutter assembly, comprising:

a one piece main body having a first side member and a second side member, each of the first side member and the second side member having a first attachment feature, wherein the first side member and the second side member are vertical stiles that are integral with horizontal louvers disposed between and connecting the first side member and the second side member, the main body including the first side member and the second side member shortened to a desired length and having cut edges; and a cap having a pair of spaced apart second attachment features, the first attachment features of the main body and the second attachment features of the cap cooperating with one another to selectively secure the cap to the main body, wherein the first attachment features receive the second attachment features and both the first attachment features and the second attachment features are entirely concealed within the main body upon installation of the shutter assembly, wherein the cap includes a groove that is formed in an outer wall of the cap, and which receives and hides the cut edges of the first side member and the second side member of the main body.

2. The shutter assembly of claim 1, wherein each of the first side member and the second side member includes a channel formed therein for receiving the second attachment feature.

3. The shutter assembly of claim 2, wherein each of the first attachment features includes a pair of spaced apart apertures formed in a wall defining a portion of the channel.

4. The shutter assembly of claim 2, including a plurality of support ribs formed in the channel.

5. The shutter assembly of claim 1, wherein each of the first side member and the second side member includes a plurality of cutting guides.

6. The shutter assembly of claim 3, wherein each of the second attachment features of the cap includes a pair of pins that cooperate with the pairs of apertures in each of the first attachment features of the main body, whereby the cooperation of the pins with the apertures squares up the cap with the main body.

7. The shutter assembly of claim 6, wherein each of the pins is split and has a beveled head to facilitate an insertion and retention of the pins in the apertures.

8. The shutter assembly of claim 1, wherein the groove has a beveled edge that facilitates an insertion of the cut edges of the main body into the groove of the cap.

9. The shutter assembly of claim 1, further including a solar module configured to power a light source disposed adjacent one of the main body and the cap.

10. A shutter assembly, comprising:

a main body having a first side member and a second side member, each of the first side member and the second side member having a first attachment feature; and a cap having a pair of spaced apart second attachment features, the first attachment features of the main body and the second attachment features of the cap cooperating with one another to selectively secure the cap to the main body, wherein each of the first side member and the second side member includes a channel formed therein for receiving the second attachment feature, wherein each of the first attachment features includes a pair of spaced apart apertures formed in a wall defining a portion of the channel, wherein each of the second attachment features of the cap includes a pair of pins that cooperate with the pairs of apertures in each of the first attachment features of the main body, whereby the cooperation of the pins with the apertures squares up the cap with the main body, wherein each of the pins is split and has a beveled head to facilitate an insertion and retention of the pins in the apertures, and wherein each of the second attachment features of the cap includes an outwardly extending arm on which the pair of pins is disposed.

11. The shutter assembly of claim 10, wherein each of the arms has an attaching portion and a flexing portion, the pair of pins disposed on the attaching portion.

12. The shutter assembly of claim 11, wherein the attaching portion is a free end coupled to the flexing portion, and the flexing portion is coupled to the cap.

13. The shutter assembly of claim 12, wherein the flexing portion has a thickness less than a thickness of the attaching portion to permit a flexing of the second attachment features when cooperating with the first attachment features.

14. A shutter assembly, comprising:

a one piece first main body and a one piece second main body, each of the first main body and the second main body having a first side member and a second side member, each of the first side member and the second side member having first attachment features, wherein the first side member and the second side member are vertical stiles that are integral with horizontal louvers disposed between and connecting the first side member and the second side member;

a first cap and a second cap, each of the first cap and the second cap having a pair of spaced apart second attachment features; and an extender having a primary body with vertical stiles that are integral with a horizontal member, the primary body including pairs of additional second attachment features on opposing sides thereof, wherein the additional second attachment features on one side of the extender and the first attachment features of the first main body cooperate with one another, and the additional second attachment features on another side of the extender and the first attachment features of the second main body cooperate with one another, wherein the extender is selectively secured between and connects the first main body and the second main body, wherein the first attachment features of the first main body and the second attachment features of the first cap cooperate with one another to selectively secure the cap to the first main body, and the first attachment features of the second main body and the second attachment features of the second cap cooperate with one another to selectively secure the second cap to the second main body, the first cap and the second cap secured at opposing ends of the shutter assembly, wherein the first attachment features receive the second attachment features and both the first attachment features and the second attachment features are entirely concealed within one of the first main body and the second main body upon installation of the shutter assembly, wherein the first cap includes a first groove that is formed in an outer wall of the first cap, and which receives and hides the cut edges of the first side member and the second side member of the first main body, and wherein the second cap includes a second groove that is formed in an outer wall of the second cap, and which receives and hides the cut edges of the first side member and the second side member of the second main body.

15. A shutter assembly kit, comprising:

a one piece main body having a first side member and a second side member, each of the first side member and the second side member having a first attachment feature, wherein the first side member and the second side member are vertical stiles that are integral with horizontal louvers disposed between and connecting the first side member and the second side member, the main body including the first side member and the second side member configured to be shortened to a desired length and form cut edges; and a cap having a pair of spaced apart second attachment features, the first attachment features of the main body and the second attachment features of the cap configured to cooperate with one another to selectively secure the cap to the main body, wherein the first attachment features are configured to receive the second attachment features and both the first attachment features and the second attachment features are entirely concealed within the main body upon assembly of the main body with the cap and installation of the shutter assembly, wherein the cap includes a groove that is formed in an outer wall of the cap, and which is configured to receive and hide the cut edges of the first side member and the second side member of the main body.

16. A method for customizing a shutter assembly, comprising the steps of:

providing a shutter assembly kit having a one piece main body with a first side member and a second side member, each of the first side member and the second side member having a first attachment feature, wherein the first side member and the second side member are vertical stiles that are integral with horizontal louvers disposed between and connecting the first side member and the second side member, and the shutter assembly further having a cap having a pair of second attachment features, the first attachment features of the main body and the second attachment features of the cap configured to cooperate with one another to selectively secure the cap to the main body;

determining a desired length of the main body;

cutting the main body to the desired length, wherein cut edges are formed on the first side member and the second side member; and attaching the cap to the main body, wherein the cap includes a groove that is formed in an outer wall of the cap, and which receives and hides the cut edges of the first side member and the second side member of the main body.

* * * * *